US009624674B2

(12) United States Patent
Lee

(10) Patent No.: US 9,624,674 B2
(45) Date of Patent: Apr. 18, 2017

(54) INSTALLABLE GRAFFITI AND TAGGING INHIBITING PANELS

(71) Applicant: Phillip Lee, Folsom, CA (US)

(72) Inventor: Phillip Lee, Folsom, CA (US)

( * ) Notice: Subject to any disclaimer, the term of this patent is extended or adjusted under 35 U.S.C. 154(b) by 16 days.

(21) Appl. No.: 14/120,677

(22) Filed: Jun. 16, 2014

(65) Prior Publication Data

US 2015/0361672 A1 Dec. 17, 2015

(51) Int. Cl.
*E04F 13/072* (2006.01)
*E04F 13/08* (2006.01)
*E04F 13/12* (2006.01)

(52) U.S. Cl.
CPC ..... *E04F 13/072* (2013.01); *E04F 13/0862* (2013.01); *E04F 13/0871* (2013.01); *E04F 13/12* (2013.01); *E04F 2203/00* (2013.01)

(58) Field of Classification Search
CPC ..... E04F 13/072; E04F 13/12; E04F 13/0871; E04F 13/0862; Y10T 428/24273; B32B 3/12
USPC ..... 52/656.8, 204.61, 660; 160/104
See application file for complete search history.

(56) References Cited

U.S. PATENT DOCUMENTS 2,280,631 A * 4/1942 Coffey ..... 181/293
2,609,068 A * 9/1952 Pajak ..... E04C 2/365 101/382.1
3,887,031 A * 6/1975 Wirt ..... 181/286
3,895,152 A * 7/1975 Carlson et al. ..... 428/116
4,001,473 A * 1/1977 Cook ..... 428/116
4,111,585 A * 9/1978 Mascaro ..... E01C 9/004 404/36
4,122,915 A * 10/1978 Taguchi ..... 181/284
4,292,356 A * 9/1981 Whitemore ..... B32B 3/12 156/286
4,336,292 A * 6/1982 Blair ..... B32B 3/12 228/175
4,344,266 A * 8/1982 Gray ..... B32B 3/12 156/71
4,621,942 A * 11/1986 Hill ..... E01C 9/004 404/35
4,731,279 A * 3/1988 Isshiki ..... 428/159
5,000,998 A * 3/1991 Bendig et al. ..... 428/117
5,180,619 A * 1/1993 Landi et al. ..... 428/116
5,250,340 A * 10/1993 Bohnhoff ..... 428/99
5,675,318 A * 10/1997 Hunt, Jr. ..... 340/540
5,743,488 A * 4/1998 Rolston et al. ..... 244/53 B
5,771,654 A * 6/1998 Moore et al. ..... 52/742.14
5,830,529 A * 11/1998 Ross ..... 427/152
5,923,003 A * 7/1999 Arcas et al. ..... 181/292
(Continued)

*Primary Examiner* — Ryan Kwiecinski
*Assistant Examiner* — Alp Akbasli
(74) *Attorney, Agent, or Firm* — Mark C Jacobs

(57) ABSTRACT

A baffle formed of square tubing having four faces, each face having a series of openings therein, The baffles are joined in off set rows and offset columns, with a space between each pair of baffles, vertically and horizontally, preferably in rows of six to form an anti-graffiti baffle assembly that has thirty six baffles therein. The individual baffles can be welded or otherwise attached to each other to form the baffle assembly, and which assembly is attached to either a substrate to be protected, or attached to a pair of spaced mounting posts which in turn are mounted to a substrate by four flat plates that are strategically attached to the baffle assembly to act as a mounting means.

16 Claims, 7 Drawing Sheets

(56) References Cited

U.S. PATENT DOCUMENTS

| | | | | |
|---|---|---|---|---|
| 8,020,662 | B1 * | 9/2011 | Colon et al. | 181/205 |
| 8,122,674 | B2 * | 2/2012 | Bartley | E04C 2/425 210/164 |
| 8,398,332 | B2 * | 3/2013 | Allen | E01C 9/004 404/70 |
| 8,713,870 | B1 * | 5/2014 | Poulsen | 52/263 |
| 9,068,345 | B2 * | 6/2015 | Ichihashi | |
| 2010/0227091 | A1 * | 9/2010 | Pearce | 428/36.1 |
| 2012/0048487 | A1 * | 3/2012 | Brewster et al. | 160/368.1 |
| 2014/0106114 | A1 * | 4/2014 | Baker | 428/116 |

* cited by examiner

INSTALLABLE GRAFFITI AND TAGGING INHIBITING PANELS

FIELD OF INVENTION

This invention relates to metal panels which are to be bolted or other wise attached to bridges, buildings, fences, trucks, rail cars and the like, to discourage graffiti writing and tagging. The invention also has noise dampening properties for long sound barrier walls.

BACKGROUND OF THE INVENTION

In many cities, big and small there is a large and costly problem being foisted on the taxpayers. This problem is the systematic application of graffiti and tagging-[allegedly artistic paintings, but more often than not, unrecognizable images as to subject matter by the general populous]. These undesired images are applied to both public and private surfaces, such as rail cars, subway cars, bridge structures, building walls and fences to name but a few items that suffer this counterculture application of spray paint, and marker pens. For this reason, many cities ban the sale of spray paint to persons under 18 years of age. The recent increase of punishment by extended prison terms and larger fines, for those caught committing these illegal acts has not had a significant impact on the deterrence of such acts. Even the requirement for juvenile offenders to apply paint over the graffiti and tagging on victim structures to conceal the tagging and graffiti has only helped to a limited degree. Something that will act as more of a deterrent to the viewing of the completed art work has been needed to alleviate the thrill of seeing one's own graffiti or tagging art in public places and on private property.

Applicant who is an engineer by training has witnessed the application of graffiti and tagging, herein after G & T, countrywide, from his former home city of Stockton, Ca., to New York City. He decided to find a way to abate the problem. This invention is the result of his efforts.

SUMMARY OF THE INVENTION

This invention comprises an optional metallic base plate to which a series of forwardly disposed perforated square tubing spaced members, called baffles, are attached as by spot welding or other similar means to form a completed anti graffiti (AG) panel. A series of joined baffles with a space between adjacent baffles, may be employed with or without a base or backer plate, and the attached series is designated a baffle assembly. The assembly is fashioned with alternating rows and columns of uniformly spaced open ended baffles, in an offset relationship. That is, a space is present between each two baffles vertically and horizontally/Thus both height and the width of two rows and two columns of an assembly would have 2× the number of baffles in any one row or column due to the alternate spacing between baffles.

Two baffle assemblies may also be mounted on spaced pairs of specifically designed mounting posts, instead of to a mounting base plate, but either way assemblies would be attached to either the substrate directly or to the mounting posts by 4 spaced flat plates integrated into the assembly in a non aligned mode, 2 on the top row and 2, on the bottom row of the assembly There are various terms to be understood in connection with this invention. One baffle is a an individual perforated square tube member, of a finite height width and depth, to be discussed infra. A plurality of these baffles spaced apart in 6 rows high and 6 rows wide, in offsetting spaced rows, and attached to each other is called a baffle assembly. When two of these baffle assemblies are attached side by side to the mounting posts of this invention, we have a baffle assemblage. A wall or bridge covered, with a plurality of assemblies or assemblages would be deemed a panel. Such an area could be long and wide like a plate girder bridge or high, and less wide like a building wall.

All of the baffles may be oriented the same direction, vertically or horizontally or they may be interspersed, vertically and horizontally, if a difference is made in the location of, and perhaps the size and shape of the perforations on the faces of the square tubing. The preferred embodiment utilizes the same size, shape and location for the perforations on all 4 faces of the square tubing, but as noted such is not required. The base, if employed may be square rectangular or any other shape desired. The elongated square tubing based baffles, individually are generally sized 2 in . . . ×2 in . . . ×6 inches deep. A 12 baffle×12 baffle joined section is designated a baffle assembly. The joined baffles may be attached in differing alignments, that is on a mounting plate adjacent to a mounting post to create a different aesthetic appearance, or as configurations of the surface to be protected, may dictate.

A closer inspection however reveals the fact that a 12 baffle by 12 baffle is really only 6 baffles in any one column or row as the baffles are mounted in an offset manner both horizontally and vertically. Each panel's top row has a mounting flange at its upper left corner, and a mounting flange, after the $5^{th}$ baffle, and prior to the $6^{th}$ baffle. The bottom row of each assembly has a mounting flange between the $1^{st}$ and $2^{nd}$ baffles, and a mounting flange after the $6^{th}$ baffle. This is due to the offset arrangement both horizontal and vertical with the open space in between in both directions between adjacent baffles.

The individual baffles may be maintained as bare metal, anodized, or painted as may be desired to suit the particular substrate to which the panel(s) are to be attached. Baffle assemblies and baffle assemblages, may be anodized, left as bare metal, powder coated or even painted as may be desired.

DESCRIPTION OF THE PREFERRED EMBODIMENT

Figure 1:
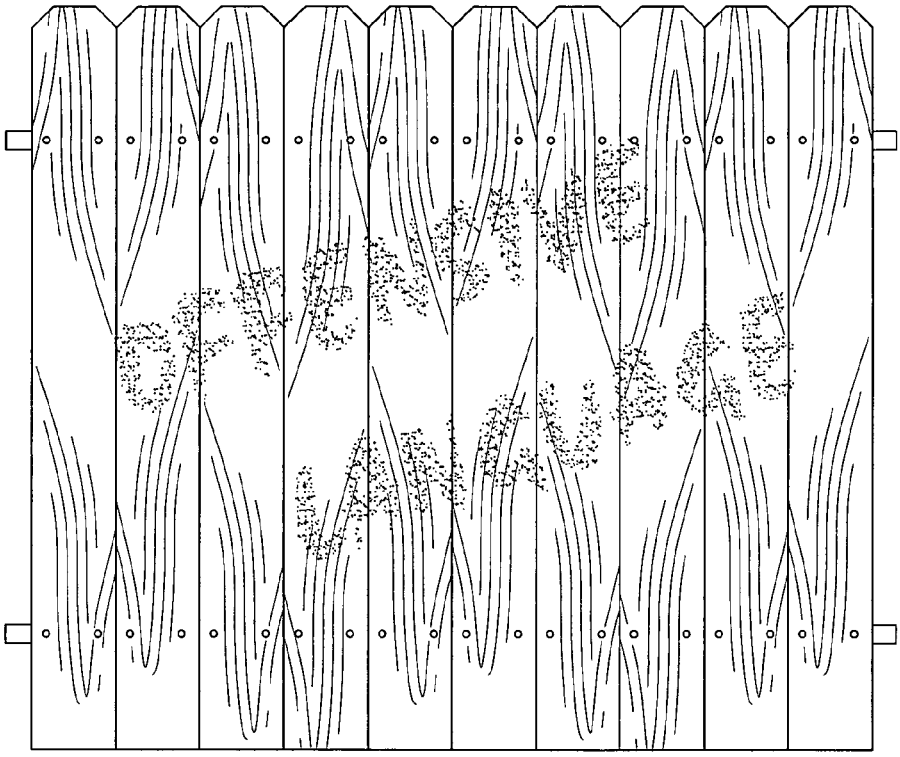
Fig. 1 (Prior Art)
FIG. 1 is a typical wood fence section which has been subjected to the application of spray paint offensive language. (Prior art)

In FIG. 1 there is seen a wood fence bearing offensive language thereon. This graffiti can be painted over, chemically treated to remove the graffiti, or the wood fencing can be replaced. Unfortunately, in most instances it is not cost effective to use the apparatus of this invention on a wood fence, as wood fences can be replaced at relatively low cost.

While all of the above named processes are but temporary fixes, none of these options attack the problem head on of deterrence, as opposed to compensating for the efforts of the tagger, that is reacting to such attacks after the fact. The invention of this application constitutes a before the attack approach to the graffiti and tagging, problem, herein after "G & T".

Figure 2:
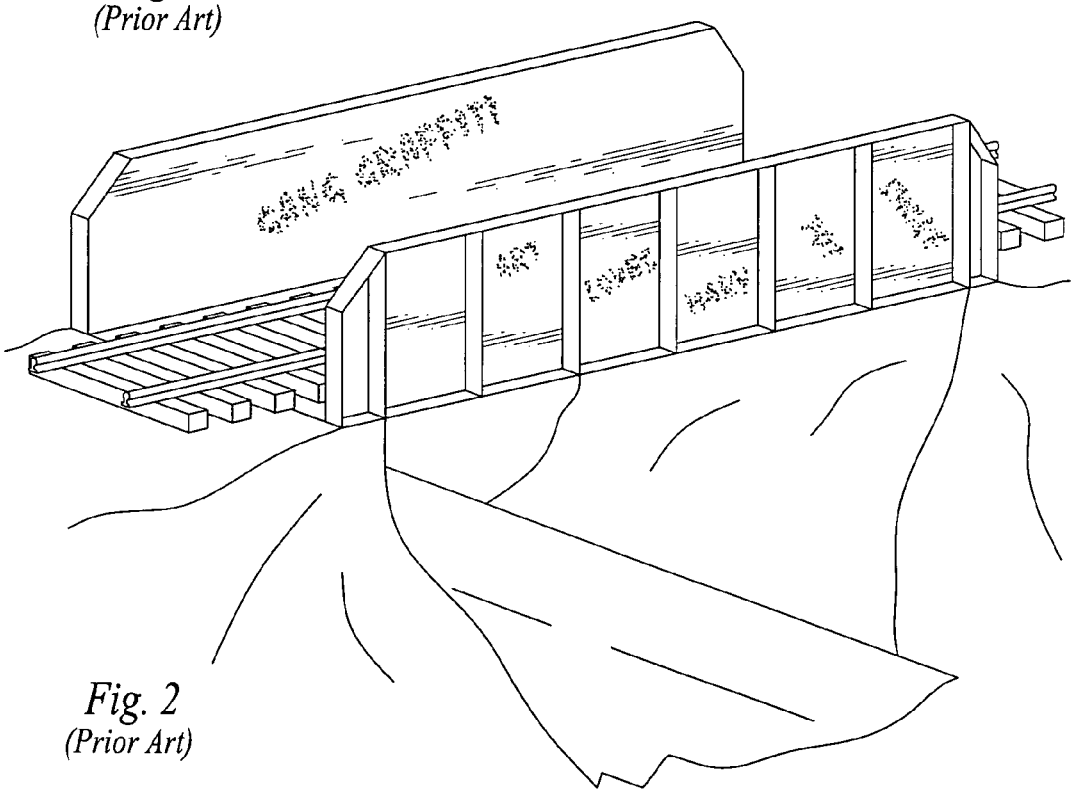
Fig. 2 (Prior Art)
FIG. 2 is a plate girder railroad bridge over a city street, to which graffiti has been applied. (Prior Art)

In FIG. 2 a typical plate girder bridge, used for both roads and railroads is seen spanning a city street. This bridge is close to a city street, and access to the rails and the bridge from the city street is easy for persons on foot. Thus bridges such as this one are quite susceptible to tagging. Usually bridges of steel are painted gray but sometimes black or even white. Research has shown that black paint and white paint are the most common colors used by G & T artists. Perhaps this is due to the ready availability of these two colors, and that these colors offer the most contrast to black, white and gray original surfaces when applied to them. On the side of the bridge is seen both graffiti and tagging, which forms of art expression are considered offensive to most people, as opposed to being considered aesthetic.

Figure 3:
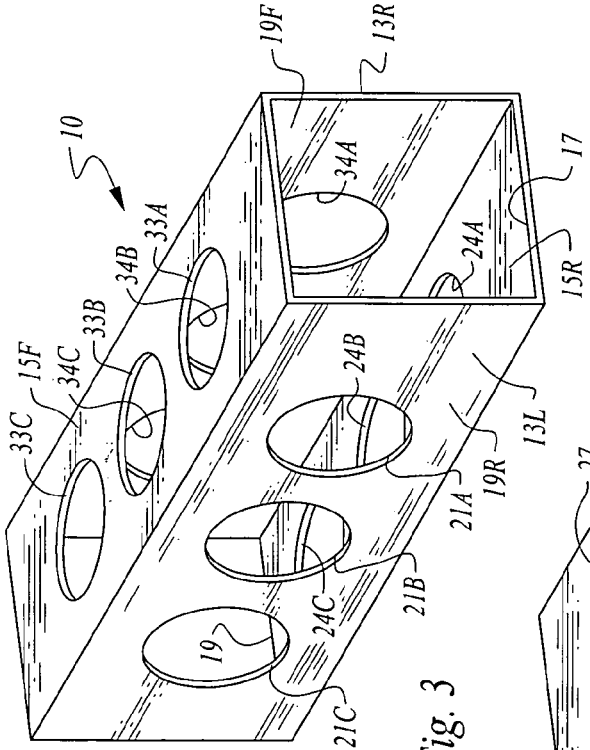
FIG. 3 is a side perspective view of a single baffle according to this invention.

FIG. 3 depicts a perspective view of one baffle, 10, used to form a baffle assembly 31 of this invention. The baffle is made of lightweight thin wall aluminum square tubing sized about 2.0 inches×2.0 inches on both the horizontal faces, 15*f* and 15R and vertical faces, 19 R and 19F and about 6.0 inches long on its sides 13L & 13R. The tubing is open at the front, 17 and rear cross sections, 19 and preferably each face has a series of perforations or openings, 21, therein. Here each face or side has three 1.25 inch diameter inch circular openings, These openings are designated 21 A, 21B & 21C for the left side, 33A-C for the top surface, 34 A-C for the right side and 24 A-C for the bottom surface of the baffle. The openings, for ease of manufacture can be linearly aligned both vertically and horizontally as shown here. But such, need not be the case.

Figure 4:
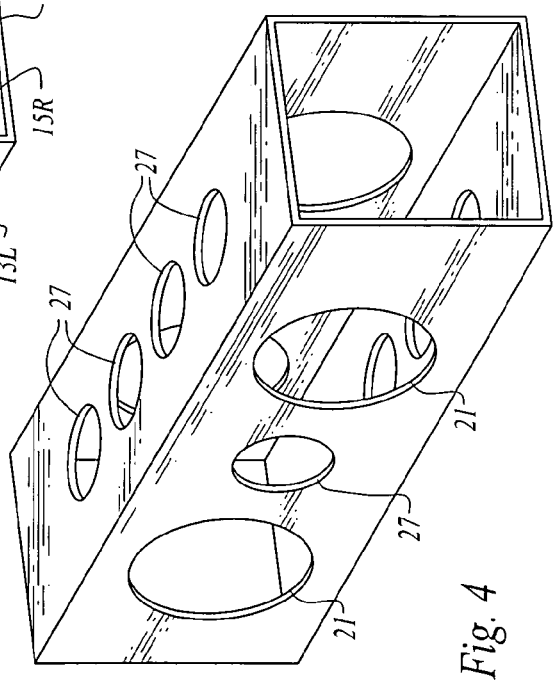
FIG. 4 is a side perspective view of a variant of the anti-tagging/anti-graffiti baffle according to this invention.

For example, FIG. 4 shows a baffle having 3 openings, 2 of one diameter designated 21, and 1 smaller opening 27, on the vertical faces, and 4 similar openings, 27, on the horizontal faces. The diameter of the openings can vary from about 0.875 inches in diameter, to about 1.25 inches in diameter, and the tubing length can vary from about 5 inches to 8 inches. In the unit shown in FIG. 3, each opening is 1.25 inches in diameter, ½ inch between hole #1 & 2, ½ inch between hole 2 & 3 and ⅞ inch from the outer right edge to hole 1 and the same from the forward edge to hole 3.

Other variations of hole patterns are also contemplated and are within the skill of the art to calculate for square tubing 2"×2"×6" as well as for other square tubing sizes which can range from about 1.5"×1.5" to 2.5"×2.5" and have a length from about 5 inches to 9 inches.

Figure 5:
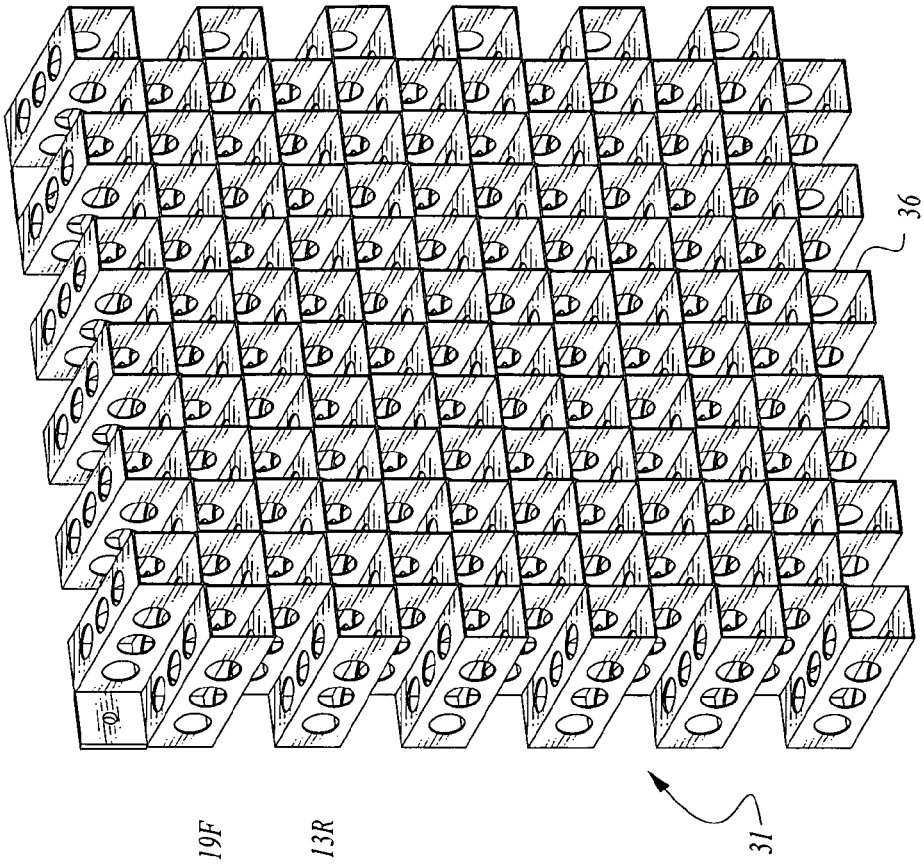
FIG. 5 is a front perspective view of an unattached baffle assembly of this invention.

FIG. 5 is a front perspective view of an unattached baffle assembly 31. Here the single baffle shown in FIG. 3 is depicted in a grid of 6 horizontal and 6 vertical baffles, with a space equal to 2"×2" between adjacent baffles both vertically and horizontally. This assembly is deemed to be unattached as it is shown unattached to the mounting posts that also form a part of this invention and which are discussed infra. In order to achieve this baffle assembly 36 baffles are laid out in a jig such that they can be welded, glued or otherwise attached to one another in this dual direction spaced relationship of 6 by 6 baffles. Also in this view the optional baffle backer board or backer plate is seen attached as by welding, or through another known technique to the rear face of the baffle assembly. There are both benefits and detriments to the use of the optional backer board. Beneficially, any spray paint not dispersed within the baffle members, will collect on the back board, thus protecting the substrate that is desired to be protected from graffiti. On the other hand, the backer board, a.k.a. backer plate, adds cost and weight to each baffle assembly to be mounted. It is contemplated that customers will balance their needs and make the correct decision about using the optional backer plate for their particular needs. The backer plate when employed is a flat panel of sheet metal, preferably stainless steel to avoid rust and interaction with any surface to which it may be attached including the mounting posts shown in FIGS. 6 and 7. When employed it is suggested that the backer plate be sized to cover most but not all individual baffles, to render the attachment of the assembly to the substrate or mounting posts easier. That is the flat plates used for mounting to the mounting posts should remain uncovered.

Figure 6:
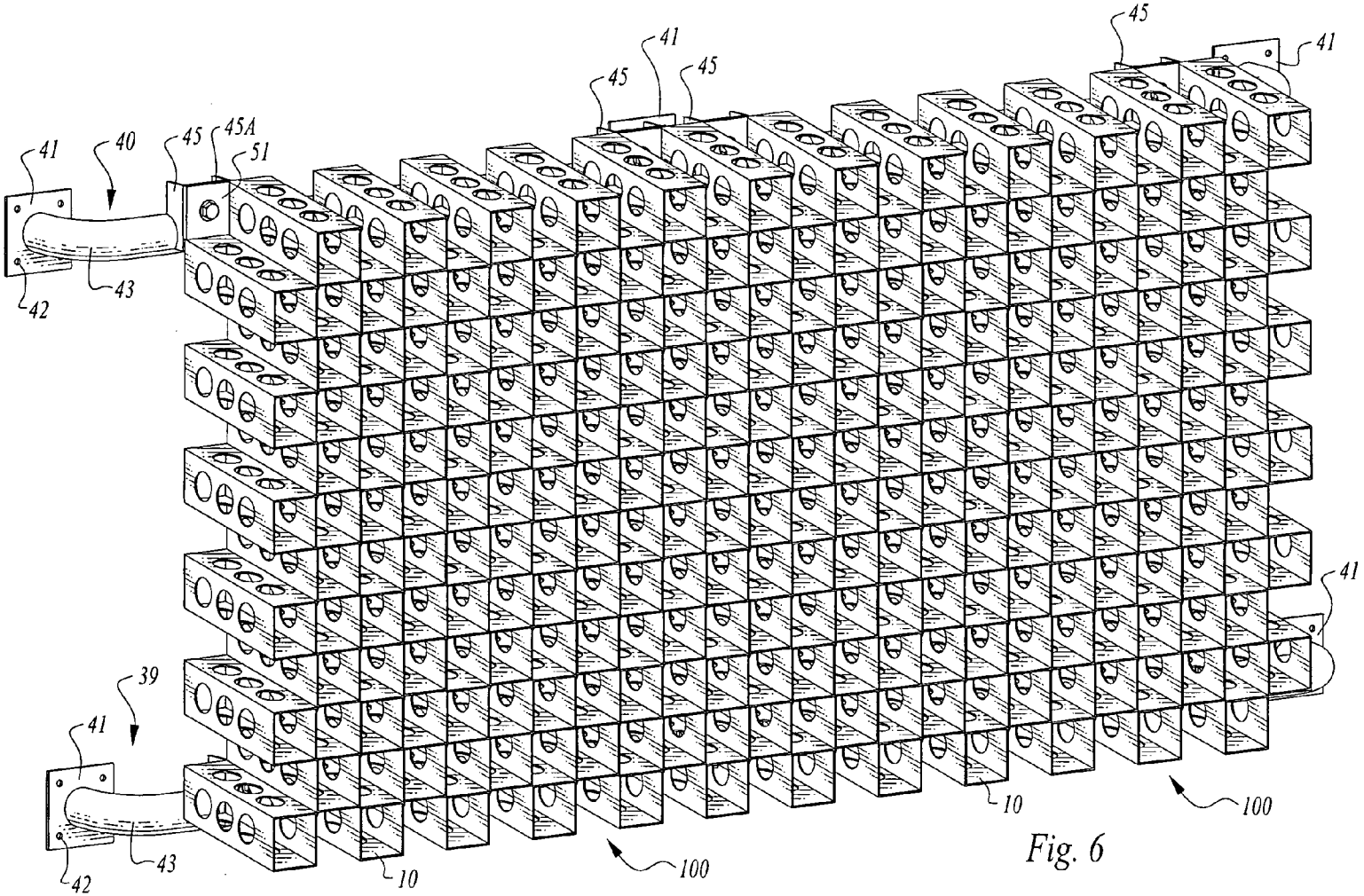
FIG. 6 is a top front perspective view of a pair of horizontally aligned baffle assemblies of this invention wherein the baffles of the panels are similar on all faces, and the assemblies are mounted on two spaced mounting posts.
Figure 7:
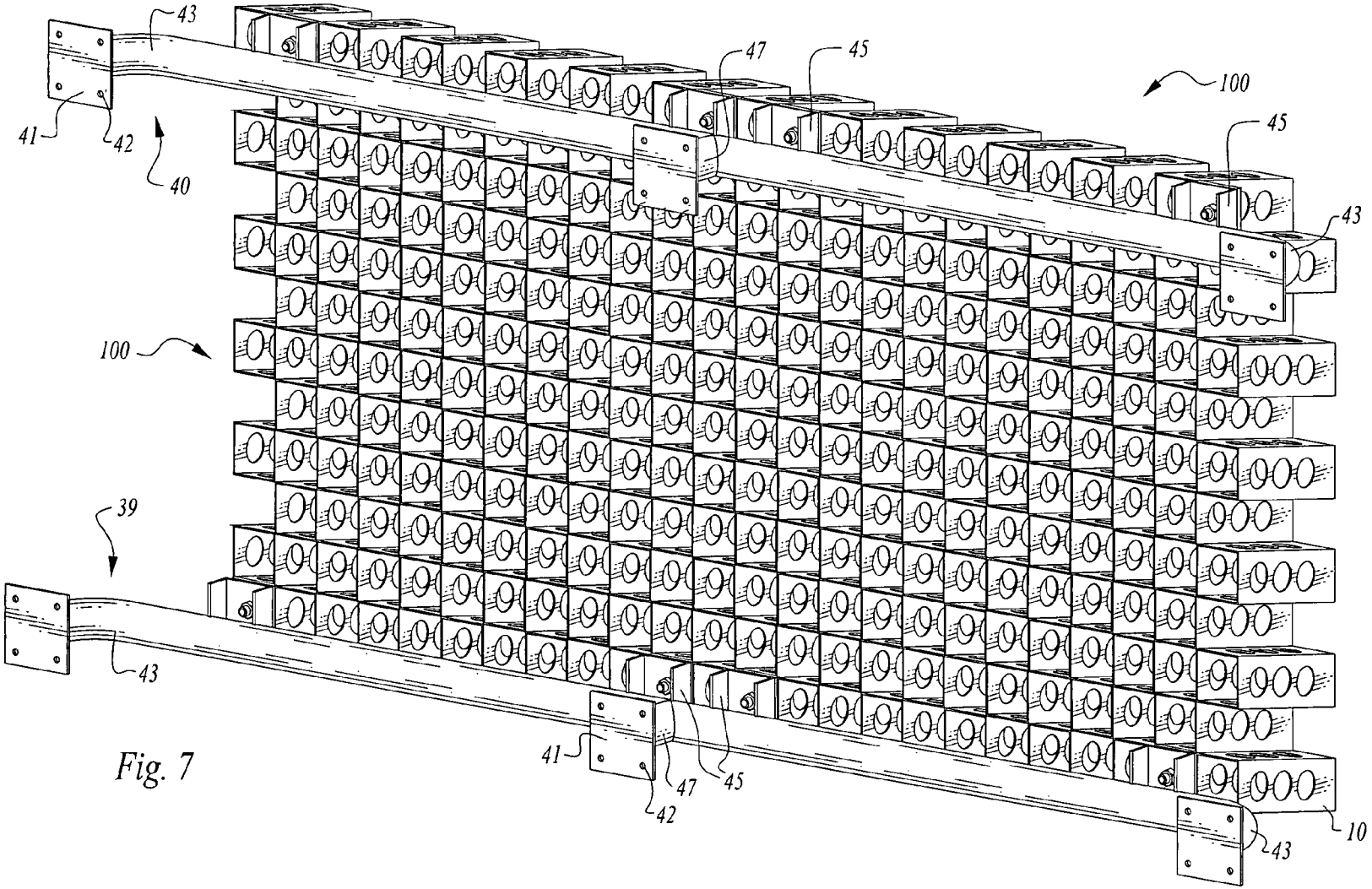
FIG. 7 is a rear perspective view of the panel of FIG. 6.

In FIG. 6, there is shown a front perspective view of 2 baffle assemblies 10, seen placed side by side and attached to two vertically spaced mounting posts 40. Reference is also made to FIG. 7, which is a rear perspective view of the two mounted baffle assemblies. Since both mounting posts are the same only the upper one will be described in detail and the slight distinction in the lower one will be set out as well.

In these views, the pair of side by side baffle assemblies, 100, are seen to be attached to a pair of spaced mounting posts, 39, each of which has four mounting flanges 45 that are attached to the u-tube 43 as discussed infra. Each u-tube 43 is a bent tubular member whose diameter is welded or otherwise attached at its terminii to a wall plate 41, which while shown as square need not be that shape. Each wall plate 41 has a series of throughbores for screws or bolts for attachment to the surface to be protected such as a building wall. The mount flanges 45 are seen to be a 3 piece structure having a front flat member 45A, and two members each of which has an arcuate cutout that matches the radius of the U-tube. See both Figures. Obviously the mount flanges may be made as one piece or three pieces welded together as is understood in the metal craft art.

Between the wall plates 41 is a wall assembly 48 comprised of a wall plate 40 and a short tube 47, having an arcuate cutout along the length of the short tube that matches the radius of the u-tube to permit a 90 degree junction of element 47 to the U-tube. Note also the presence of throughbores 42 in the center mount plate 40.

As can be seen in FIG. 7, two centrally disposed mount flanges are seen, one for the edge of each of the two baffle assemblies. The baffle assemblies may be welded or otherwise attached to the u-tubes 43, prior to the attachment of the mounting posts 39 to a substrate or after the mounting posts are attached to the substrate, not seen in these two figures. While the term u-tube has been employed for element 43, the element can also be a solid bar instead of being a tubular member if desired, especially if an aluminum alloy is used instead of steel.

The mode of attachment of each baffle assembly to the mount flanges 45 is by the use of bolts or screws which pass through strategically placed pairs of spaced flat plates 51 which are disposed within the baffle assembly itself between spaced baffles. These flat plates are best seen in the single baffle assembly of FIG. 12. The flat plates 51 are noted as 51A at the top right of the rear view here; 51B between the $5^{th}$ and $6^{th}$ individual top row of baffles; 51C at the far left at the bottom; and 51D between the $1^{st}$ and $2^{nd}$ individual baffles on the bottom row. Thus the flat plates are NOT aligned either horizontally or vertically within the baffle assembly, 100. Due to the location of the flat plates on the baffle assembly differing from top to bottom, the location of the mount flanges 45 on the upper mounting post 40 and lower mounting post 39 differ to accommodate the different spacings of the flat plates 51. The reader is referred to FIG. 12, which more easily depicts the distinct locations of the flat plates 51 at the top and bottom of a baffle assembly.

It is also to be noted that in the front view FIG. 6, no backer plate is employed on either baffle assembly, but in FIG. 7, a backer plate is present on each baffle assembly, but the flat plates for mounting are left unimpeded.

Figure 8:
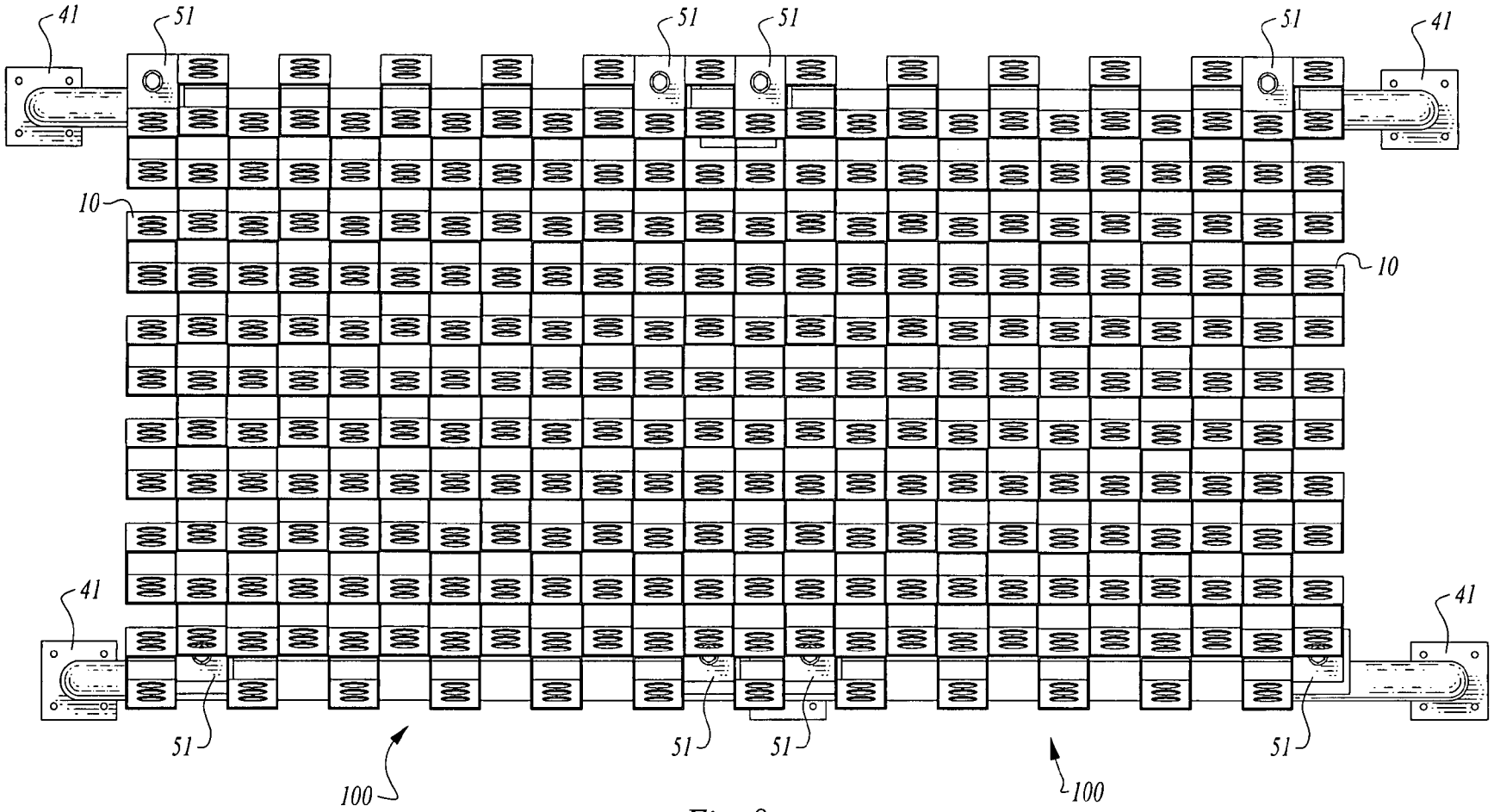
FIG. 8 is a front elevational view of a panel (mounting posts+2 baffle assemblies) of this invention.

In FIG. 8, a front view without the backer plate, one can see the 4 flat plates for mounting at the far left upper corner and the far right lower corner, but the flat plates 51 are set in 2 inches in the upper right and lower left corners of the double baffle assembly, such that plate is disposed between the first and second individual baffles in the lower left and upper right areas. Note also the absence of a backer plate in FIG. 8 such that paint has a further distance to travel before impaction on a surface normal to the spraying "artist". That is paint needs to travel all the way beyond the mounting posts to the substrate intended for protection.

Figure 9:
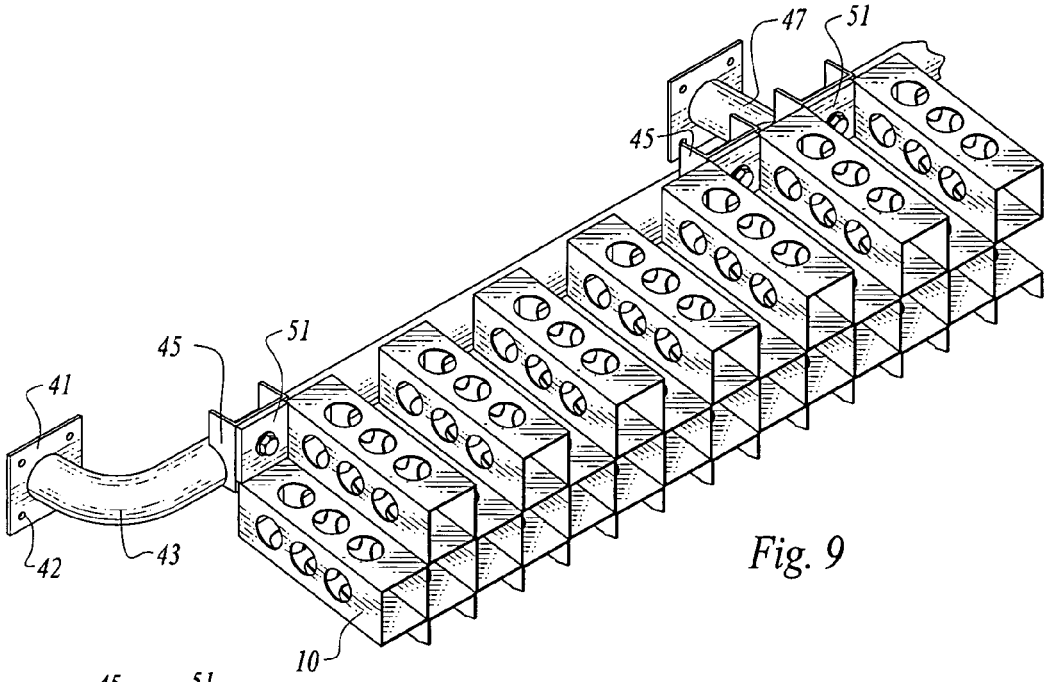
FIG. 9 is a closeup view showing the mode of attachment of a baffle assemblage to a mounting post forming part of this invention.

In FIG. 9, the upper left flat plate 51 is seen closeup attached to the upper mounting post, and the two adjacent interior flat plates are also seen side by side attached to their respective flanges 45.

Figure 10:
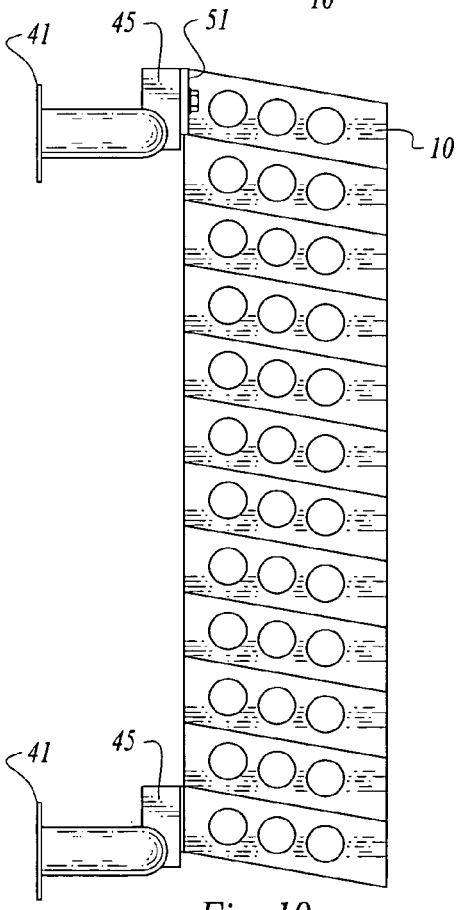
FIG. 10 is a right side elevational view of an assembly of baffles, mounted at a 10 degree offset from the horizontal.

FIG. 10 is a side elevational view of a baffle show n attached to an upper and to a lower mounting post. In this view the baffle assemblies, only the side of one of which assembles can be seen are mounted, not 90 degrees to the ground, but here at a 10 degree offset downward. It is preferred to mount the baffles at between a 5 degree and a 15 degree offset, as an angular disposition has been found to collect more paint internally, especially on the interior upper surface of the baffles, than if the baffle were mounted without an offset, ie straight up and down. In this view the baffles employed are the individual baffles found in FIG. 3 of this application.

Figure 11:
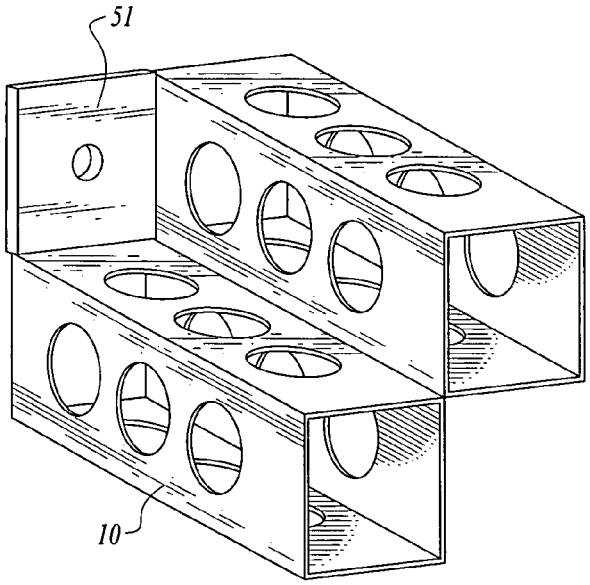
FIG. 11 is a closeup view of the mount flange in the upper right corner of a baffle assembly.

FIG. 11 is a front closeup perspective view that illustrates the upper left corner of a baffle assembly showing the exterior flat plate 51 for attachment and several individual baffles. To ease the understanding of the structure slanted shading lines have been added to show which upper face and lower face go together with side surfaces to form an individual baffle.

Figure 12:
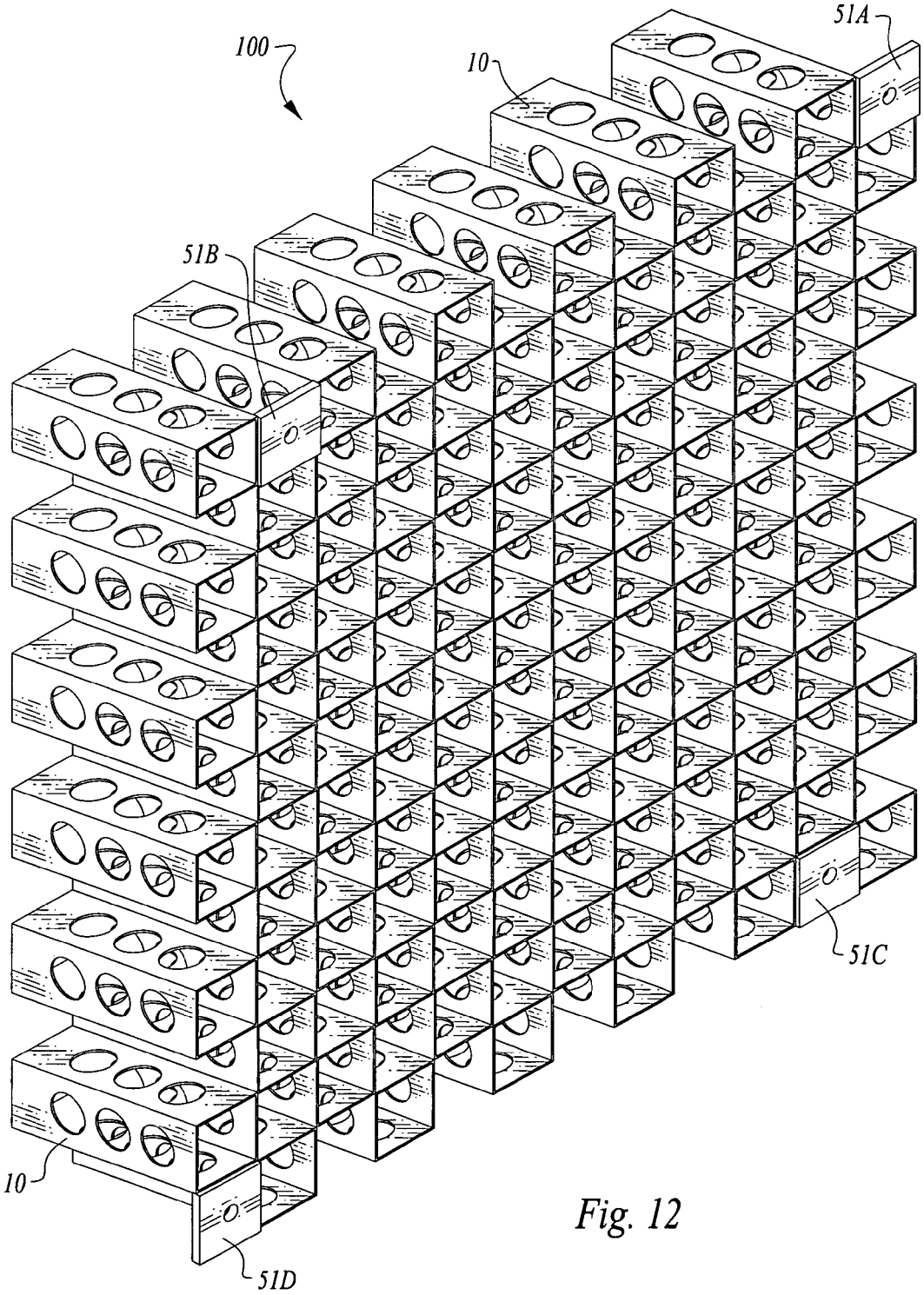
FIG. 12 is a rear perspective view of the baffle assembly of FIG. 5 without a backer plate.

FIG. 12 is a rear perspective view of a baffle assembly showing the 4 flat plates, 51A, which from a front view would be the upper left corner. Plate 51B. Is the inset right mount, and 51C is the lower right corner mount when front viewed, and 51D is the inset lower left flat plate for attachment to the substrate or mounting post. FIG. 12 also helps the reader to understand the 6×6 offset of the individual baffles to form this 2 foot by 2 foot baffle assembly.

It is seen that I have created an apparatus that when mounted on a substrate inhibits a graffiti artist's artistic episode, by dispersing the cone shaped spray that emanates from a spray can such that the image or message is readily indiscernible, thus frustrating the efforts of the so called artist. The relative cost of installation of the apparatuses of this invention on a substrate are small in comparison to the sum of the expenses for the periodic removal of graffiti from walls, bridges, and other substrates.

While I have suggested that the baffles be about 6 inches in elongation, the baffles can range from about 5 inches from front to back to about 10 inches, with 6 inches being preferred. While I have shown 2 foot square assemblies of 36 baffles each, larger and smaller baffle assemblies, both square and rectangular fall within the scope of this invention.

As to color, the assemblies of this invention may have a random color scheme (non-uniform) or a color scheme of one or more colors to either blend in or be different from the substrate to which the assemblies are mounted.

Since certain changes may be made I the above apparatus without departing from the scope of the invention herein involved, it is intended that all matter contained in the above description and shown in the accompanying drawings, shall be interpreted as illustrative only and not in a limiting sense.

I claim:

1. A baffle assembly configured to be installed parallel to a surface of a vertical structure to inhibit graffiti comprising: a plurality of baffles, wherein each of the plurality of baffles comprise individual elongated open ended square tubing having a plurality of openings between 0.875 inches in width to 1.25 in width, wherein each of the plurality of baffles being joined with a space equal to the width of one of each of the plurality of baffles between adjacent ones of the plurality of baffles, in both row and column directions, the junction of adjacent ones of the plurality of baffles made by welding, soldering, or adhering to yield the baffle assembly wherein each of the plurality of baffles are mounted at between a 5 degree and a 15 degree downward offset from a horizontal plane.

2. A baffle assembly configured to be installed parallel to a surface of a vertical structure to inhibit graffiti comprising: a plurality of baffles arranged in alternating rows and columns of uniformly spaced open ended baffles, each of the plurality of baffles being spaced from an adjacent one of the plurality of baffles by a space equal to the size of each of the plurality of baffles, both vertically and horizontally, wherein each of the plurality of baffles is an elongated square tube with a series of openings on each surface of said each of the plurality of baffles and wherein each of the plurality of baffles are mounted at between a 5 degree and a 15 downward offset from a horizontal plane, and wherein each of the plurality of baffles has 3 to 4 openings in each of the four faces of the square tube, and said tubes are 5 to 8 inches in length.

3. The baffle assembly of claim 2 wherein each of the plurality of baffles in the assembly is 6 inches long and each of the plurality of baffles is mounted at a 10 degree downward offset from the horizontal plane.

4. The baffle assembly of claim 3 wherein each surface has 3 to 4 openings therein and 4 flat spaced mounting plates are attached to the assembly in a vertical and horizontal offset pattern.

5. The baffle assembly of claim 4, wherein there are 6 baffles horizontally and 6 baffles vertically and each surface has 3 circular openings therein.

6. The baffle assembly of claim 2 further including a backer plate to which the baffle assembly is attached prior to mounting to a substrate.

7. A baffle assemblage comprising at least two baffle assemblies configured to be installed parallel to a surface of a vertical structure to inhibit graffiti comprising of a plurality of alternating rows of individual perforated elongated square tubing baffles, wherein said baffles having a width, and said spaces between adjacent baffles are equal to said width, both horizontally and vertically, each of the at least two baffle assemblies has flat mounting plates thereon on a top row and bottom row thereof, said at least two baffle assemblies being disposed side by side and attached by the mounting plates to two vertically spaced apart mounting posts, said baffles being downwardly disposed from a horizontal plane at an angle between 5 degrees and 15 degrees, and wherein each of said baffles has 3 to 4 openings in each of the four faces of the square tubing.

8. The baffle assemblage of claim 7 wherein each of said two mounting posts comprises a generally U-shaped member and having an upper post section and a lower post section each having mounting flanges thereon located to align with the flat mounting plates of the at least two baffle assemblies, wherein each of the upper post section mounting flanges align with the mounting plates of a top row of the at least two baffle assemblies, and wherein the lower post section mounting flanges align with the mounting plates of a bottom row of the at least two baffle assemblies.

9. The baffle assemblage of claim 8 further including wall plates attached to the termini of each U-shaped mounting post, to attach the mounting posts to a substrate.

10. The baffle assemblage of claim 8 further including a backer plate fixedly interposed between the each of at least two baffle assemblies and the mounting posts.

11. The baffle assemblage of claim 7 wherein the diameter of the openings are between 0.875 inches in width to 1.25 inches in width, and the tubing length is between 5 inches to 8 inches.

12. A graffiti inhibiting panel comprising a plurality of horizontally aligned, and vertically spaced, and vertically aligned mounting posts having a plurality of baffle assemblies attached in horizontal pairs on spaced pairs of mounting posts, which mounting posts are attached to a substrate to be protected from graffiti and tagging, wherein each of the plurality of baffle assemblies is comprised of a plurality of baffles, that are individual elongated square tubing that are open ended, having a plurality of openings of from 0.875 inches in width to 1.25 inches in width, wherein each of the plurality of baffles being joined with a space equal to the width of one of each of the plurality of baffles between adjacent each of a plurality of baffles, in both row and column directions, the junction of adjacent ones of the plurality of baffles made by welding, soldering, or adhering to yield the baffle assembly wherein the each of the plurality of baffles are mounted between a 5 degree and a 15 degree downward offset from a horizontal plane.

13. The graffiti inhibiting panel of claim 12, wherein each mounting post has 4 mounting plates, two on opposite ends of said mounting post, and two centrally located to align the 4 mounting plates of two horizontally disposed baffle assemblies.

14. The graffiti inhibiting panel of claim 12, wherein the baffle assemblies are anodized, left as bare metal, powder coated, or painted to suit a particular substrate to which the graffiti inhibiting panel is to be attached.

15. The graffiti inhibiting panel of claim 13, wherein a backer plate is fixedly interposed between each baffle assembly and its respective mounting post.

16. The graffiti inhibiting panel of claim 15 wherein the backer plate is a flat panel comprising stainless steel.

* * * * *